US007056107B2

(12) United States Patent
Shinoda et al.

(10) Patent No.: US 7,056,107 B2
(45) Date of Patent: Jun. 6, 2006

(54) VANE TYPE ROTARY MACHINE

(75) Inventors: Masao Shinoda, Kanagawa (JP); Chishiro Yamashina, Kanagawa (JP); Shimpei Miyakawa, Kanagawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/492,631

(22) PCT Filed: Oct. 15, 2002

(86) PCT No.: PCT/JP02/10654

§ 371 (c)(1),
(2), (4) Date: Oct. 4, 2004

(87) PCT Pub. No.: WO03/033912

PCT Pub. Date: Apr. 24, 2003

(65) Prior Publication Data

US 2005/0042126 A1 Feb. 24, 2005

(30) Foreign Application Priority Data

Oct. 16, 2001 (JP) ..... 2001-318327

(51) Int. Cl.
*F03C 2/00* (2006.01)
*F04C 2/00* (2006.01)

(52) U.S. Cl. ..... 418/15; 418/259; 418/260

(58) Field of Classification Search ..... 418/15, 418/23, 260, 268, 259
See application file for complete search history.

(56) References Cited

U.S. PATENT DOCUMENTS 2,333,323 A * 11/1943 Livermore ..... 418/268
4,963,080 A 10/1990 Hansen

FOREIGN PATENT DOCUMENTS

| | | | |
|---|---|---|---|
| EP | 101758 | A1 * | 3/1984 |
| EP | 0761973 | A2 * | 12/1997 |
| GB | 388990 | * | 3/1933 |
| JP | 2-298683 | | 12/1990 |
| JP | 5-164061 | | 6/1993 |
| JP | 2592508 | | 12/1996 |
| JP | 9-79156 | | 3/1997 |
| JP | 9-158868 | | 6/1997 |
| SU | 700684 | * | 12/1979 |

* cited by examiner

*Primary Examiner*—Theresa Trieu
(74) *Attorney, Agent, or Firm*—Westerman, Hattori, Daniels & Adrian, LLP.

(57) ABSTRACT

The present invention relates to a vane-type rotary machine suitable for use in applications where a low-viscosity fluid such as water is used as a working fluid. According to the present invention, a vane-type rotary machine having a rotor (11) mounted with vanes and rotatably housed in a cam casing (10) includes a motor supply opening (or pump discharge opening) (30) for a working fluid, a motor return opening (or pump suction opening) (20) formed in the cam casing for a working fluid, and branch flow passages (23, 25, 33 and 35) branched from the motor supply opening (or pump discharge opening) and the motor return opening (or the pump suction opening) and communicating with vane chambers (22, 24, 32 and 34). The distances of the branch flow passages are identical to each other.

4 Claims, 8 Drawing Sheets

VANE TYPE ROTARY MACHINE

TECHNICAL FIELD

The present invention relates to a vane-type rotary machine (a vane pump and a vane motor), and more particularly to a vane-type rotary machine suitable for use in applications where a low-viscosity fluid such as water is used as a working fluid.

BACKGROUND ART

FIGS. 1 and 2 are views showing a structure of a conventional typical balanced vane-type rotary machine. As shown in FIGS. 1 and 2, a balanced vane-type rotary machine 100 comprises a rotor 102 housed in a cam casing 101, vanes 103 inserted in the rotor 102 and having distal ends held in contact with an inner circumferential surface of the cam casing 101, a front cover 104 and an end cover 105 surrounding both sides of the rotor 102 and the vanes 103 inserted in the rotor 102, and a main shaft 109 coupled to the rotor 102 and rotatably supported by bearings 106, 107 mounted in the front cover 104 and the end cover 105. The cam casing 101 of the balanced vane-type rotary machine 100 has first ports (discharge ports if the balanced vane-type rotary machine 100 is a pump, supply ports if the balanced vane-type rotary machine 100 is a motor) 110, 110 and second ports (suction ports if the balanced vane-type rotary machine 100 is a pump, return ports if the balanced vane-type rotary machine 100 is a motor) 111, 111, the first ports 110, 110 and the second ports 111, 111 being located at two locations symmetrical with respect to the main shaft 109 of the rotor 102. Reference numeral 114 represents vane slits.

If the balanced vane-type rotary machine 100 is a pump, then when the rotor 102 is rotated as indicated by the broken-line arrow A2, a working fluid drawn from a suction opening 112 as indicated by the broken-line arrow A1 flows from the second ports 111, 111 into the rotor 102. Then, a pumping action of suction and discharge of the working fluid is carried out twice while the rotor 102 is making one revolution, and then the working fluid is discharged through the first ports 110 from a discharge opening 113 as indicated by the broken-line arrow A3.

If the balanced vane-type rotary machine 100 is a motor, then a working fluid supplied from a supply opening (discharge opening of the pump) 113 as indicated by the solid-line arrow B1 flows from the two first ports 110, 110 into the rotor 102, and the pressure of the introduced working fluid acts on the vanes 103 projecting from the rotor 102 to produce a torque, thereby rotating the rotor 102 as indicated by the solid-line arrow B2. Thereafter, the working fluid is discharged through the second ports 111, 111 from a return opening (suction opening of the pump) 112 as indicated by the solid-line arrow B3.

In both of a pump or a motor, because the balanced vane-type rotary machine 100 is provided with the two first ports (discharge ports if the balanced vane-type rotary machine 100 is a pump, supply ports if the balanced vane-type rotary machine 100 is a motor) 110, 110 and the two second ports (suction ports if the balanced vane-type rotary machine 100 is a pump, return ports if the balanced vane-type rotary machine 100 is a motor) 111, 111, symmetrically with respect to the main shaft 109, the pressure around the rotor 102 is in equilibrium, and the shaft loads, caused by the fluid pressure, in the radial direction of the main shaft 109 are balanced, thus reducing bearing loads.

If the balanced vane-type rotary machine 100 is a pump, then the first ports 110, 110 serve as fluid discharge ports, and the second ports 111, 111 serve as fluid suction ports. When the main shaft 109 rotates (the rotor 102 rotates), the suction opening 112 draws the fluid, and the discharge opening 113 discharges the fluid. If the balanced vane-type rotary machine 100 is a motor, then the first ports 110, 110 serve as fluid supply ports, and the second ports 111, 111 serve as fluid return ports. The pressurized fluid from the supply opening (discharge opening of the pump) 113 produces a driving force to rotate the rotor, and the fluid returns through the return opening (suction opening of the pump) 112 to a tank. Next, problems of the vane motor having the above conventional structure will be described below:

[Problem 1]

In the vane-type rotary machine (used as a motor) having the structure shown in FIGS. 1 and 2, as shown in FIG. 3, two branch flow passages 122, 123 branched at a branch point 124 of the supply opening (supply port) (discharge opening of the pump) 113 and communicating with two vane chambers 120, 121, and two branch flow passages 132, 133 extending from two vane chambers 130, 131 to the return opening (return port) (suction opening of the pump) are arranged as follows: The length $L_{122}$ of the branch flow passage 122 (the supply opening 113→the branch point 124→the branch flow passage 122→the vane chamber 120), and the length $L_{123}$ of the branch flow passage 123 (the supply opening 113→the branch point 124→the branch flow passage 123→the vane chamber 121) have a relationship of $L_{122} \neq L_{123}$. The length $L_{132}$ of the branch flow passage 132 (the return opening 112→a branch point 134→the branch flow passage 132→the vane chamber 130) and the length $L_{133}$ of the branch flow passage 133 (the return opening 112→ the branch point 134→the branch flow passage 133→the vane chamber 131) have a relationship of $L_{132} \neq L_{133}$.

For downsizing the vane-type rotary machine (a pump, a motor), the diameters of the respective branch flow passages need to be reduced. If the diameters of the respective flow passages are reduced in the conventional vane-type rotary machine having the branch flow passage arrangement of the above relationship ($L_{122} \neq L_{123}$, $L_{132} \neq L_{133}$), then since the distances of the branch flow passages to the vane chambers are different from each other, in the example shown in FIG. 3, most of the fluid supplied under pressure flows into the branch flow passage 122 from the supply opening 113 to the vane chamber 120 and having a short distance. However, because the branch flow passage 123 from the supply opening 113 to the vane chamber 121 is longer than the branch flow passage 122, the fluid supplied under pressure flows in a small amount into the branch flow passage 123 having a large pressure loss. The vane-type rotary machine 100 having the above conventional structure is expected to cause the following problems when it is downsized:

(1) The pressure around the rotor 102 is not held in equilibrium and radial loads acting on the main shaft 109 are nonuniform, thus posing large loads on the bearings 106, 107, and lowering the mechanical efficiency due to an increase in the friction of the bearings 106, 107 and decreasing the service life of the bearings.

(2) Since the working fluid acting on the vanes 103 is supplied substantially only from one pressure liquid chamber (the vane chamber 120 under the higher pressure), the output torque becomes small, and the mechanical efficiency is lowered.

Regarding the above, in the case where the vane motor is replaced with a vane pump (the supply flow passage system of the motor becomes the discharge flow passage system of the pump), the following problems arise for the above reasons:

(3) Since different pressures act on the pump discharge branch flow passage system (the vane chamber 120 and the vane chamber 121), the pressure around the rotor 102 is not held in equilibrium and the shaft loads in the radial direction acting on the main shaft 109 are nonuniform, resulting in an increase in the load on the bearings acting on the main shaft 109.

Inasmuch as the relationship of the suction flow passage system, i.e., the relationship of the length $L_{132}$ of the branch flow passage 132 and the length $L_{133}$ of the branch flow passage 133 is given as $L_{132} \neq L_{133}$, the following problem arises:

(4) When the fluid is drawn in, the fluid is introduced into the vane chamber 130 near the suction port. Because the vane chamber 131 spaced from the suction port is greatly affected by the suction resistance (back pressure), the fluid is introduced in a small quantity, resulting in a reduction in the pump suction performance and a reduction in the volumetric efficiency.

[Problem 2]

The problems (1) through (4) in the [Problem 1] may arise even if the branch flow passages are arranged with a relationship of $L_{122}=L_{123}$, $L_{132}=L_{133}$ ($L_{122}$ represents the length of the branch flow passage 122, $L_{123}$ represents the length of the branch flow passage 123, $L_{132}$ represents the length of the branch flow passage 132, and $L_{133}$ represents the length of the branch flow passage). Specifically, even if the lengths of the flow passages are the same, the above problems occur because different pressure losses are caused from the branch points to the vane chambers due to different diameters of the flow passages, the different numbers of bends, and the like.

Additionally, in the case where the vane-type rotary machine is downsized, the diameters and distances of the branch flow passages cannot necessarily be equalized due to dimensional limitations. The above problems can be avoided by taking measures to make the lengths and diameters of the branch flow passages identical, but those measures pose a limitation on downsizing of the vane-type rotary machine which is a major target to be achieved.

[Problem 3]

As shown in FIG. 4, the cam casing 101 of the vane-type rotary machine 100 has an inner surface configuration which is defined by large arcs 140, small arcs 141, and smooth curves interconnecting those arcs. The angular ranges of the large arcs 140 and the small arcs 141 have to be appropriately calculated and designed in order to obtain predetermined performance of the vane-type rotary machine, thereby forming the cam casing 101.

With the structure of the conventional balanced vane-type rotary machine 100, as shown in FIG. 4, the angular ranges of the large arcs 140 and the small arcs 141 have been established by forming cocoon-shaped or arcuate-recess-shaped ports 142 in the cam casing 101, or in the end cover 105 as shown in FIG. 5. For downsizing the vane-type rotary machine 100 having the conventional structure, however, the cocoon-shaped or arcuate-recess-shaped ports 142 which require special shapes and manufacturing accuracy need to be directly formed in the small-sized cam casing 101, and hence such formation is difficult and expensive. Conversely, the structure is complicated, and hence it is difficult to downsize the vane-type rotary machine.

DISCLOSURE OF INVENTION

The present invention has been made in view of the above problems. It is an object of the present invention to provide a vane-type rotary machine which can solve the problems of the balanced vane-type rotary machine of the conventional structure, can increase mechanical efficiency and bearing service life, and can be downsized.

In order to achieve the above object, according to one aspect of the present invention, there is provided a vane-type rotary machine having a rotor mounted with vanes and rotatably housed in a cam casing, comprising: a motor supply opening (or a pump discharge opening) formed in the cam casing for a working fluid; a motor return opening (or a pump suction opening) formed in the cam casing for the working fluid; and branch flow passages branched from the motor supply opening (or the pump discharge opening) and the motor return opening (or the pump suction opening) and communicating with vane chambers, the distances of the branch flow passages being identical to each other.

As described above, because the distances of the branch flow passages branched from the motor supply opening (or the pump discharge opening) and the motor return opening (or the pump suction opening) and communicating with vane chambers are identical to each other, the pressure around the rotor is in equilibrium, and radial loads acting on a rotor shaft are canceled out and the loads on bearings are reduced. Therefore, wear on the bearings is reduced, resulting in an increase in the mechanical efficiency and the service life of the bearings.

Since the fluid under pressure acting on the vanes is introduced equally into both the vane chambers communicating with the branch flow passages, the efficiency (mechanical efficiency) with respect to the output torque is not reduced.

Since the discharge pressure is applied equally to both the vane chambers which communicate respectively with the branch flow passages leading to the pump discharge opening, radial loads acting on a main shaft are canceled out, and the pressure around the rotor is held in equilibrium (is uniformized). Therefore, the loads on the bearings are reduced, leading to an increase in the mechanical efficiency and the service life of the bearings.

Even if the diameters of the branch flow passages are small, the fluid is introduced along the equal distance from the branch point of the pump suction opening into both the vane chambers, thus preventing the pump suction performance from being lowered and the volumetric efficiency from being lowered.

According to another aspect of the present invention, there is provided a vane-type rotary machine having a rotor mounted with vanes and rotatably housed in a cam casing, comprising: a motor supply opening (or a pump discharge opening) formed in the cam casing for a working fluid; a motor return opening (or a pump suction opening) formed in the cam casing for the working fluid; and branch flow passages branched from the motor supply opening (or the pump discharge opening) and the motor return opening (or the pump suction opening) and communicating with vane chambers, the pressure losses in the branch flow passages being identical to each other from ports of the branch flow passages to the vane chambers.

As described above, because the pressure losses in branch flow passages branched respectively from the motor supply opening (or the pump discharge opening) and the motor return opening (or the pump suction opening) and communicating with vane chambers are identical to each other from ports of the branch flow passages to the vane chambers, the vane-type rotary machine can be reduced in size easily and reliably, in addition to the above operation.

According to a preferred aspect, in the vane-type rotary machine, the angular ranges of a large arc and a small arc formed in the cam casing are determined by the branch flow passages.

With the angular ranges of the large arc and the small arc being determined by the branch flow passages, for downsizing the cam casing, i.e., downsizing the vane-type rotary machine, the angles of the large arc and the small arc can univocally be established by the branch flow passages that are directly worked in the cam casing. Therefore, the large arc and the small arc can be worked highly accurately and inexpensively.

BEST MODE FOR CARRYING OUT THE INVENTION

Figure 1:
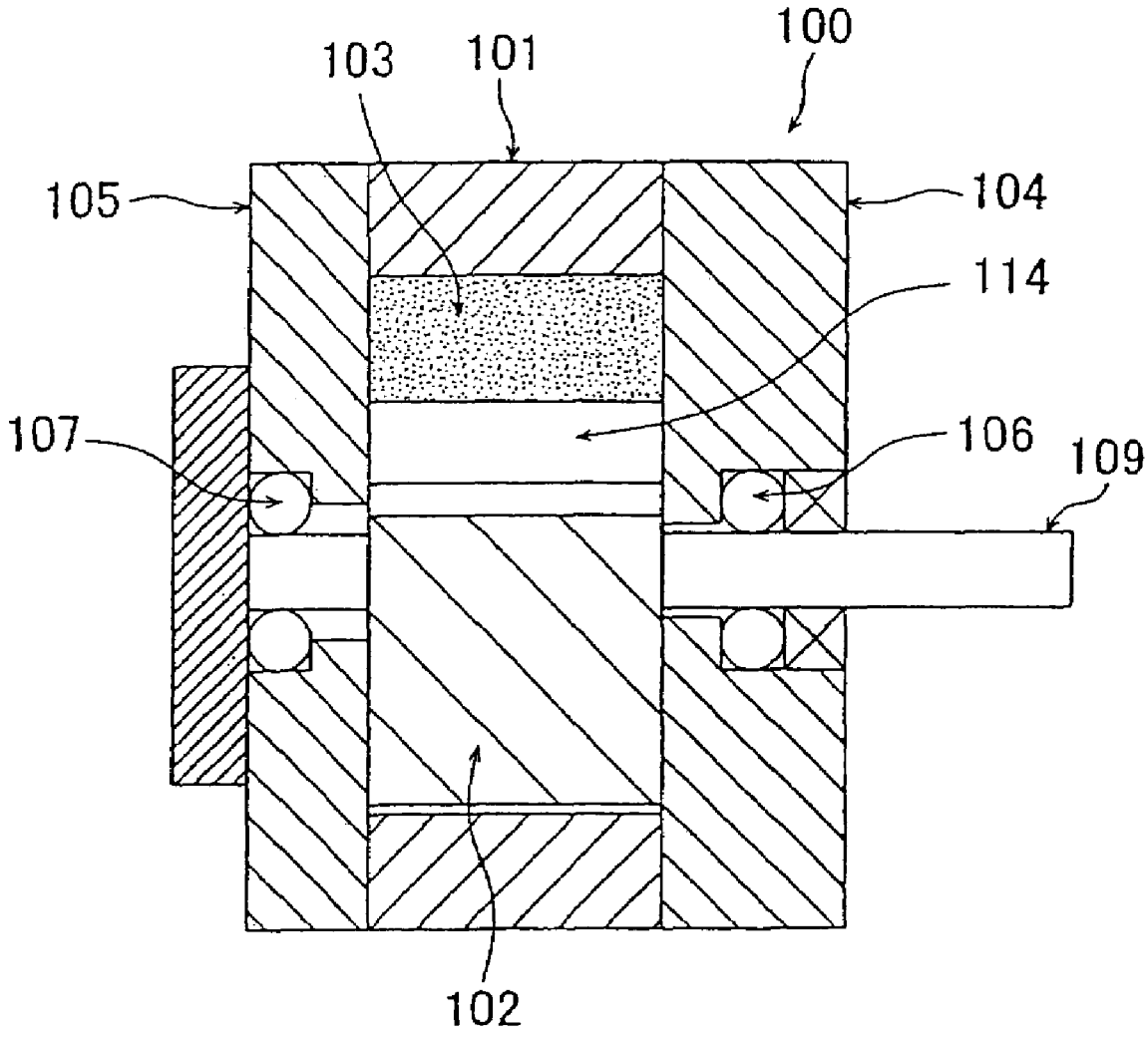
FIG. 1 (PRIOR ART)
FIG. 1 is a sectional side elevational view showing a structure of a conventional vane-type rotary machine.
Figure 2:
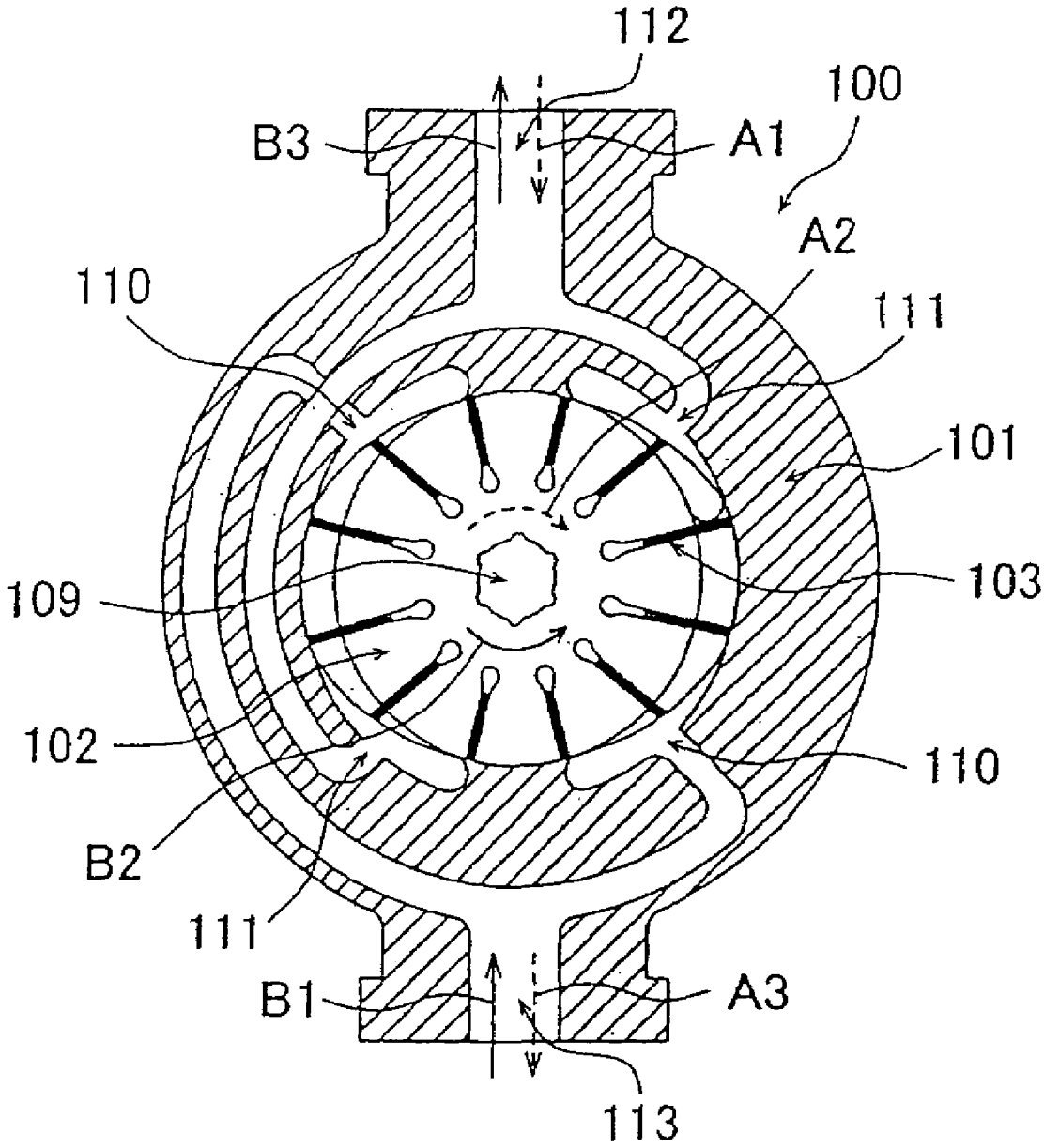
FIG. 2 (PRIOR ART)
FIG. 2 is a sectional front elevational view showing the structure of a conventional vane-type rotary machine.
Figure 3:
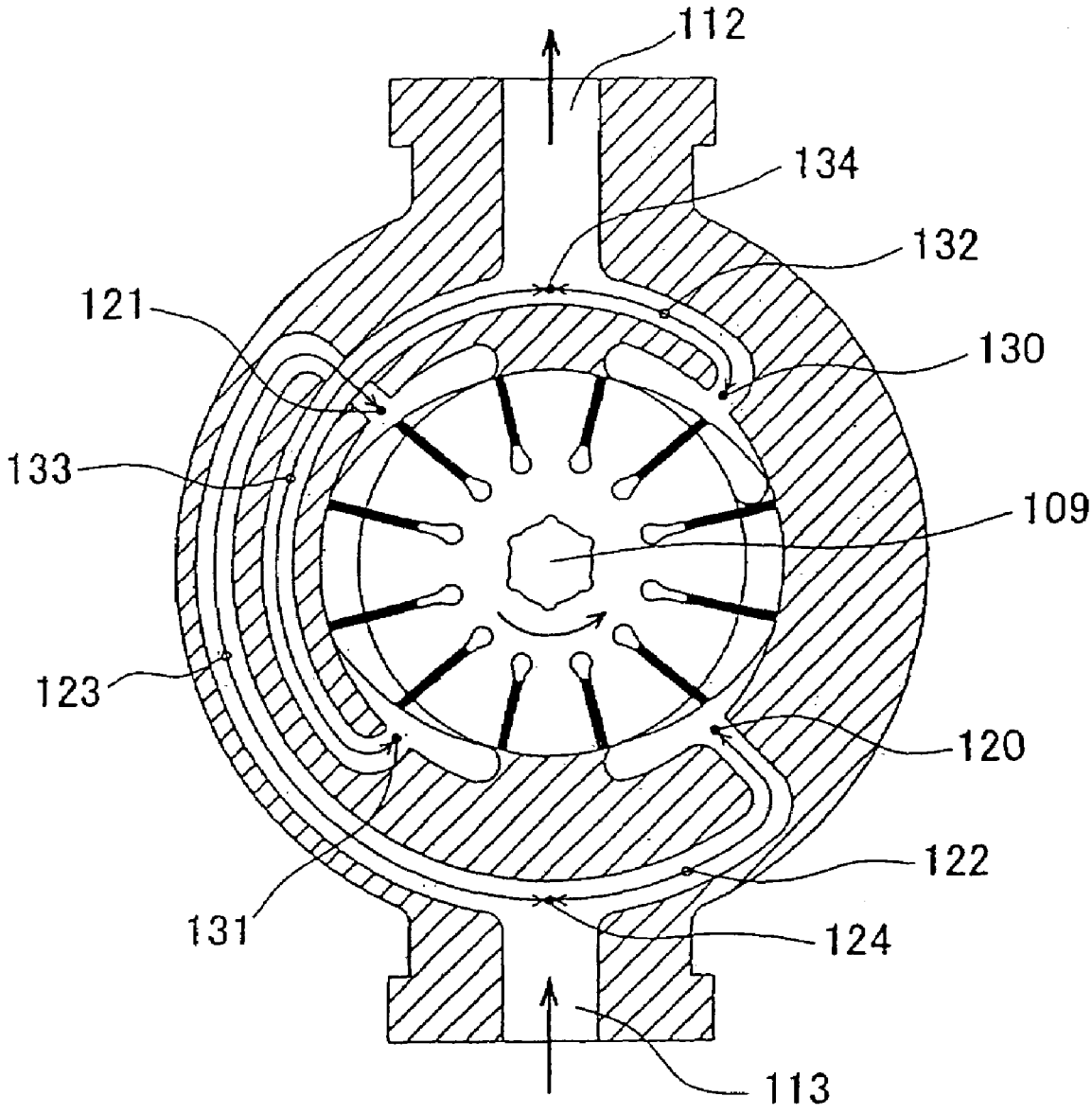
FIG. 3 (PRIOR ART)
FIG. 3 is a sectional front elevational view showing the conventional vane-type rotary machine that is used as a motor.
Figure 4:
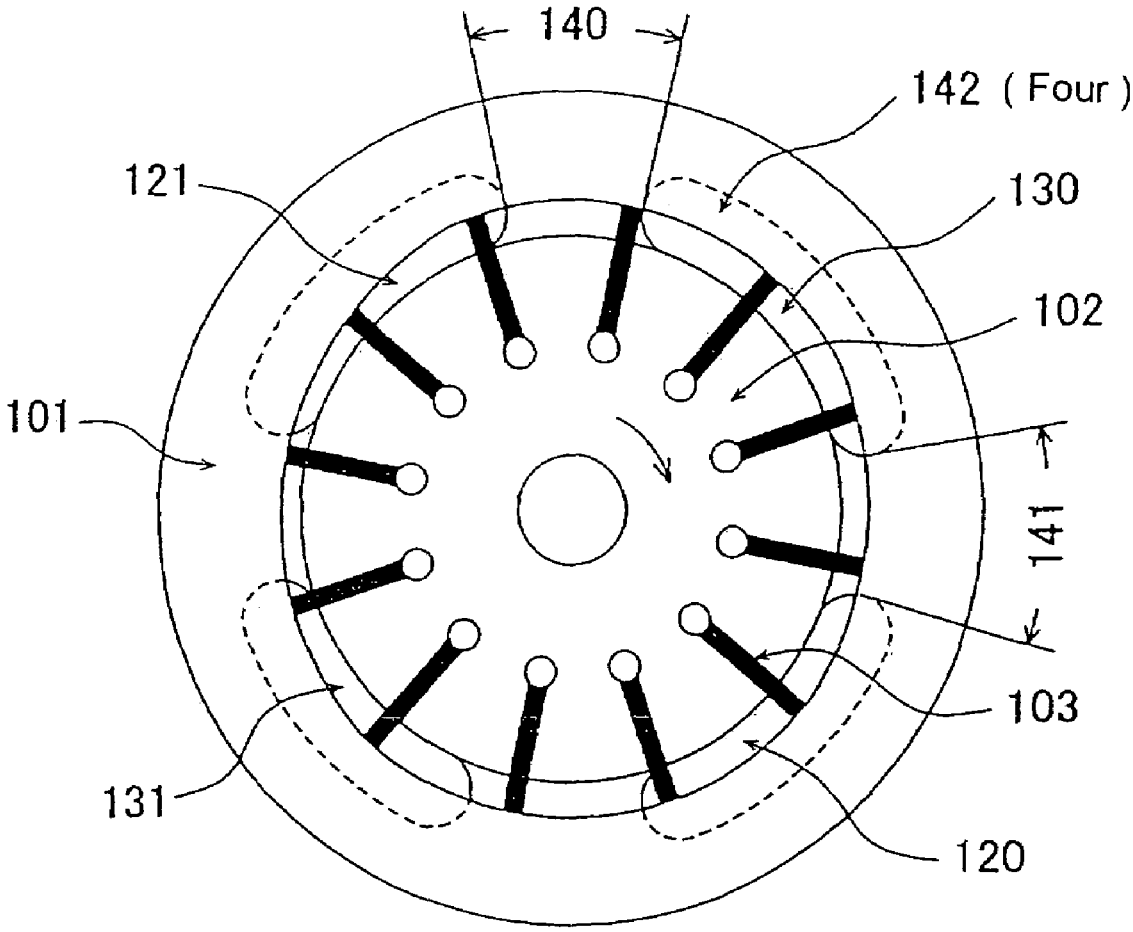
FIG. 4 (PRIOR ART)
FIG. 4 is a view showing an inner surface configuration of a cam casing of the conventional vane-type rotary machine.
Figure 5:
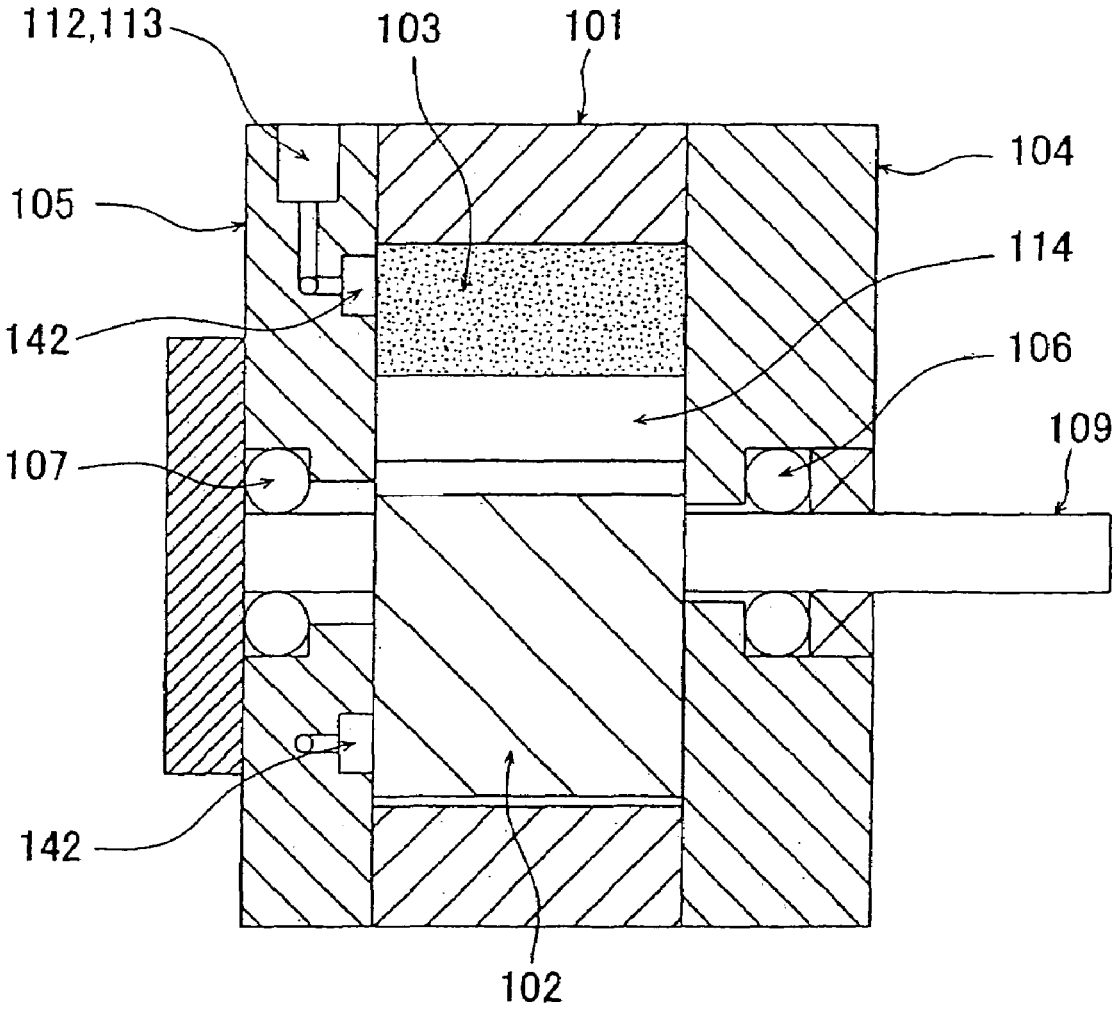
FIG. 5 (PRIOR ART)
FIG. 5 is a sectional side elevational view showing a structure of a conventional vane-type rotary machine.
Figure 6A:
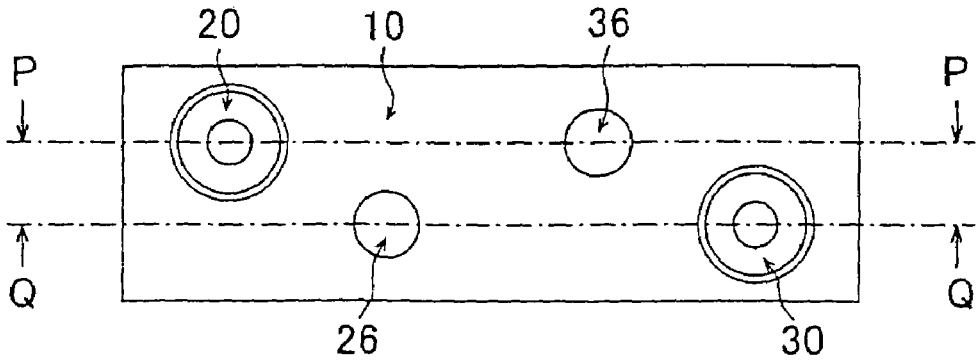
FIGS. 6A and 6B are views showing a structure of a cam casing of a vane-type rotary machine according to the present invention, FIG. 6A being a plan view, and FIG. 6B being a cross-sectional view taken along lines P—P and Q—Q of FIG. 6A.
Figure 6B:
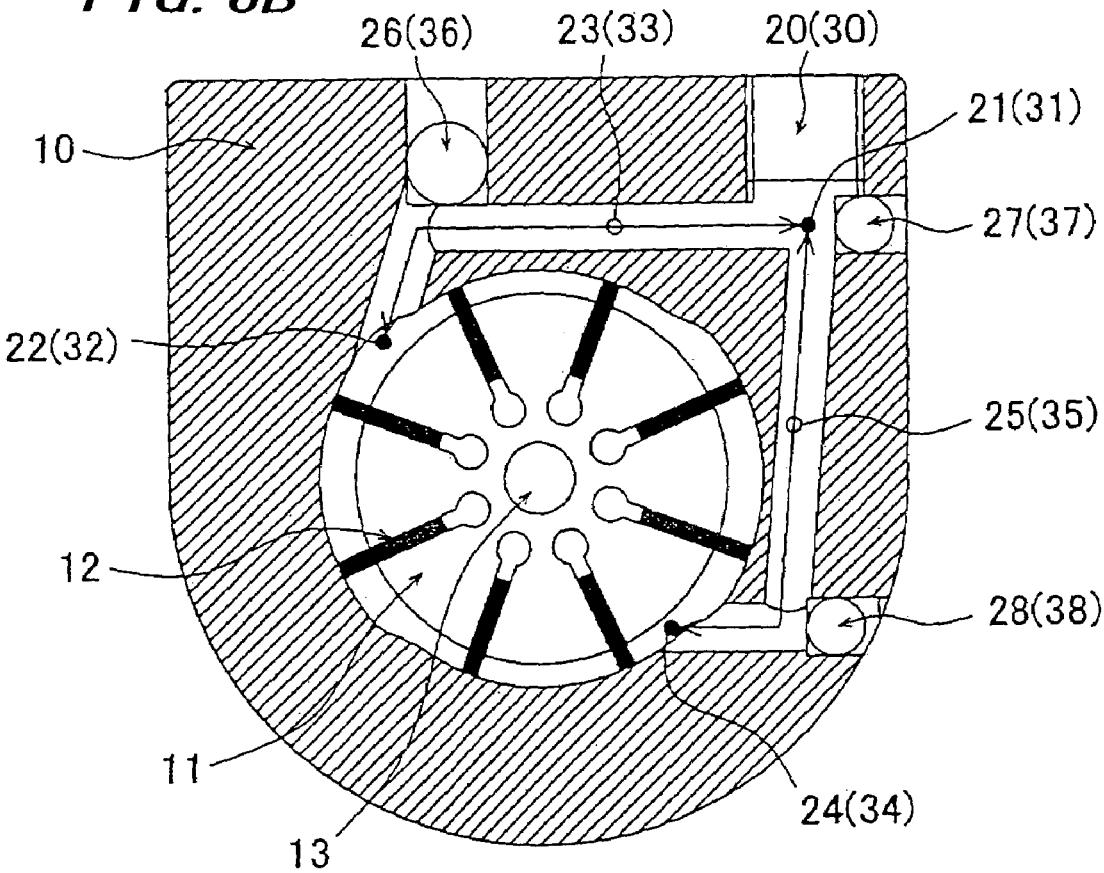

Embodiments of the present invention will be described below with reference to the drawings. Identical or corresponding parts (or elements) in FIGS. 6A, 6B through 8A, 8B are denoted by identical reference numerals. FIGS. 6A and 6B are views showing a structure of a cam casing of a vane-type rotary machine according to the present invention, FIG. 6A being a plan view, and FIG. 6B being a cross-sectional view taken along lines P—P and Q—Q of FIG. 6A. As shown in FIGS. 6A and 6B, the vane-type rotary machine has a rotor 11 housed in a cam casing 10, vanes 12 inserted in the rotor 11 and having distal ends held in contact with an inner circumferential surface of the cam casing 10, a front cover and an end cover (not shown) surrounding both sides of the rotor 11 and the vanes 12 inserted in the rotor 11, and a main shaft 13 coupled to the rotor 11 and rotatably supported by bearings (not shown) mounted in the front cover and the end cover.

The cam casing 10 has a pump suction opening (motor return opening) 20 and a pump discharge opening (motor supply opening) 30 at its upper portion. The cam casing 10 has a branch flow passage 23 extending from a branch point 21 communicating with the pump suction opening 20 to a vane chamber 22, and a branch flow passage 25 extending from the branch point 21 to a vane chamber 24. The cam casing 10 also has a branch flow passage 33 extending from a branch point 31 communicating with the pump discharge opening 30 to a vane chamber 32, and a branch flow passage 35 extending from the branch point 31 to a vane chamber 34. The reference numerals 26, 27 and 28 represent sealing plugs fitted in machining holes (holes for forming the branch flow passages 23, 25) which communicate with the branch flow passages 23, 25. The reference numerals 36, 37 and 38 also represent sealing plugs fitted in machining holes (holes for forming the branch flow passages 33, 35) which communicate with the branch flow passages 33, 35.

In the vane-type rotary machine of the above structure, the branch flow passage 23 and the branch flow passage 25 are formed so that the distance from the branch point 21 of the pump suction opening (motor return opening) 20 through the branch flow passage 23 to the vane chamber 22, i.e., the length $L_{23}$ of the branch flow passage 23, and the distance from the branch point 21 through the branch flow passage 25 to the vane chamber 24, i.e., the length $L_{25}$ of the branch flow passage 25, have a relationship of $L_{23}=L_{25}$. The branch flow passage 33 and the branch flow passage 35 are formed so that the distance from the branch point 31 of the pump discharge opening (motor supply opening) 30 through the branch flow passage 33 to the vane chamber 32, i.e., the length $L_{33}$ of the branch flow passage 33, and the distance from the branch point 31 through the branch flow passage 35 to the vane chamber 34, i.e., the length $L_{35}$ of the branch flow passage 35, have a relationship of $L_{33}=L_{35}$.

As described above, the length $L_{23}$ of the branch flow passage 23 extending from the branch point 21 to the vane chamber 22 and the length $L_{25}$ of the branch flow passage 25 extending from the branch point 21 to the vane chamber 24 are identical to each other, and the length $L_{33}$ of the branch flow passage 33 extending from the branch point 31 to the vane chamber 32 and the length $L_{35}$ of the branch flow passage 35 extending from the branch point 31 to the vane chamber 34 are identical to each other. Therefore, even if the diameters of the branch flow passages 23, 25 and the branch flow passages 33, 35 are small, the fluid under pressure from the motor supply opening 30 is uniformly supplied to the vane chambers 22, 24 and the vane chambers 32, 34, and hence the following operation and advantages can be obtained:

The pressure around the rotor 11 is in equilibrium, radial loads acting on the main shaft 13 are canceled out and the loads on the bearings are reduced. Therefore, wear on the bearings is reduced, resulting in an increase in the mechanical efficiency and the service life of the bearings.

Since the pressure acting on the vanes 12 is introduced equally into both the vane chamber 22 and the vane chamber 24, the efficiency (mechanical efficiency) with respect to the output torque is not reduced. The same explanation holds true for a pump like the case of the motor.

Since the discharge pressure is applied equally to the vane chamber 22 and the vane chamber 24 which communicate respectively with the branch flow passages 23, 25 leading to the pump discharge opening 30, radial loads acting on the main shaft 13 are canceled out, and the pressure around the rotor 11 is held in equilibrium (is uniformized). Therefore, the loads on the bearings are reduced, leading to an increase in the mechanical efficiency and the service life of the bearings.

Even if the diameters of the branch flow passages 33, 35 are reduced to make the vane-type rotary machine smaller, the fluid is introduced along the equal length (distance) from the branch point 31 of the pump suction opening 20 into the vane chamber 32 and the vane chamber 34, thus preventing the pump suction performance from being lowered and the volumetric efficiency from being lowered.

In the above embodiment, the branch flow passages are formed so that the length $L_{23}$ of the branch flow passage 23 and the length $L_{25}$ of the branch flow passage 25 have a relationship of $L_{23}=L_{25}$, and the length $L_{33}$ of the branch flow passage 33 and the length $L_{35}$ of the branch flow passage 35 have a relationship of $L_{33}=L_{35}$. However, the motor supply opening (pump discharge opening) 30 and the motor return opening (pump suction opening) 20 may be formed in the cam casing 10, and the branch flow passages may be formed so that the pressure losses from the ports of the branch flow passages 33, 35 which are branched at the branch point 31 communicating with the motor supply opening (pump discharge opening) 30 to the vane chambers, and the pressure losses from the ports of the branch flow passages 23, 25 which are branched at the branch point 21 communicating with the motor return opening (pump suction opening) 20 to the vane chambers are identical to each other.

Losses in the branch flow passages, i.e., the pressure loss $P_{23}$ in the branch flow passage 23 and the pressure loss $P_{25}$ in the branch flow passage 25, and the pressure loss $P_{33}$ in the branch flow passage 33 and the pressure loss $P_{35}$ in the branch flow passage 35, are determined by numerical calculations, and various adjustment elements including the distances of the branch flow passages, the diameters of the flow passages, the number of bends, the angles of the bends, and restrictions (restriction diameters, restriction lengths) are arranged to keep the pressure losses at a relationship of $P_{23}=P_{25}$, $P_{33}=P_{35}$, for thereby balancing the pressure losses in the branch flow passages.

In the present embodiment, it is possible to balance the pressure losses in the branch flow passages 23, 25 by making the diameter of the branch flow passage 23 greater than the diameter of the branch flow passage 25, increasing the number of bends of the branch flow passage 25, making the bend angles of the branch flow passage 25 acute, or installing restrictions having diameters (restriction diameters) and lengths (restriction lengths) that are appropriately calculated based on the pressure losses in the respective branch flow passages.

The same explanation holds true for the branch flow passage 33 and the branch flow passage 35. In brief, adjustment and design may be made to equalize the pressure losses in the respective branch flow passages by way of numerical calculations. According to the present invention, the vane-type rotary machine can be reduced in size easily and reliably.

Figure 7A:
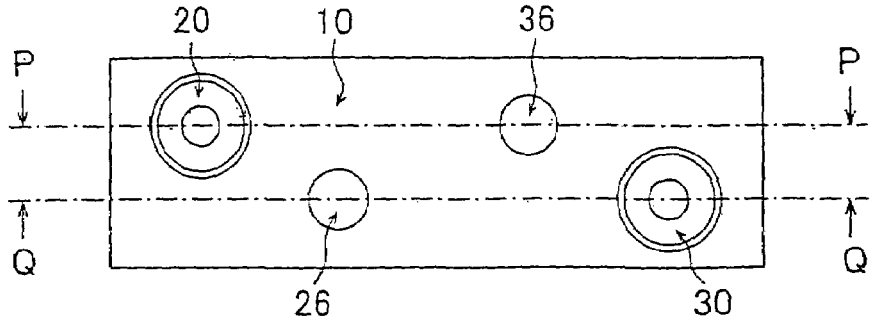
FIGS. 7A and 7B are views showing a structure of a cam casing of a vane-type rotary machine according to the present invention, FIG. 7A being a plan view, and FIG. 7B being a cross-sectional view taken along lines P—P and Q—Q of FIG. 7A.
Figure 7B:
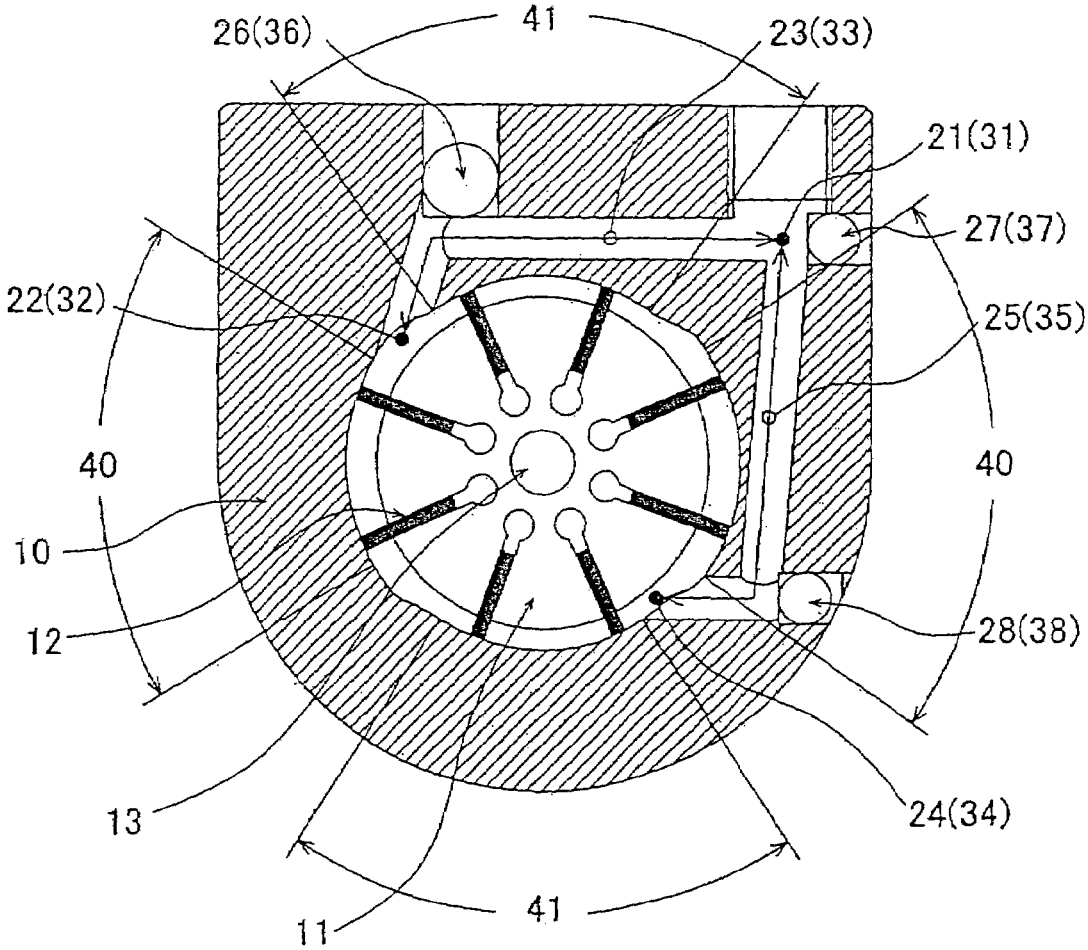
Figure 8A:
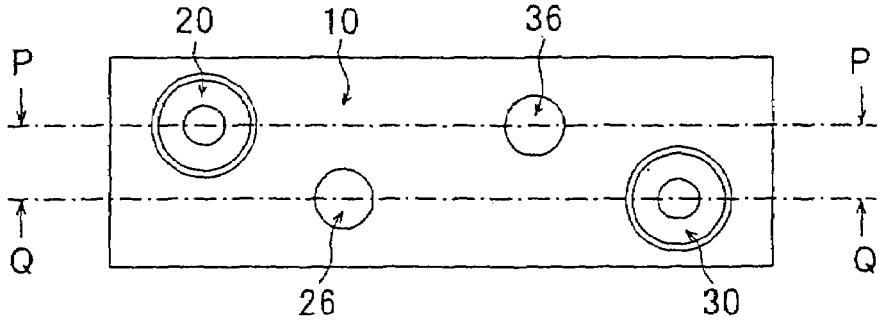
FIGS. 8A and 8B are views showing a structure of a cam casing of the vane-type rotary machine according to the present invention, FIG. 8A being a plan view, and FIG. 8B being a cross-sectional view taken along lines P—P and Q—Q of FIG. 8A.
Figure 8B:
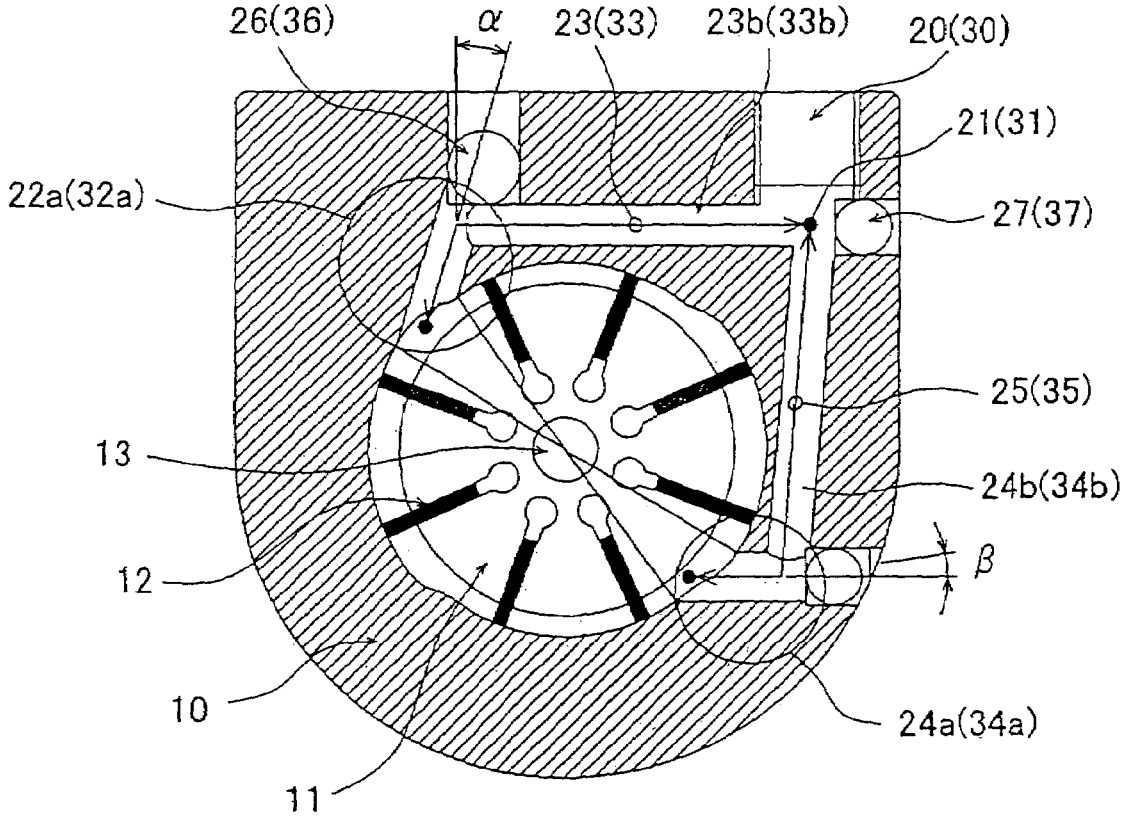

FIGS. 7A and 7B and FIGS. 8A and 8B are views showing a structure of a cam casing of a vane-type rotary machine according to the present invention. FIG. 7A is a plan view, and FIG. 7B is a cross-sectional view taken along lines P—P and Q—Q of FIG. 7A. FIG. 8A is a plan view, and FIG. 8B is a cross-sectional view taken along lines P—P and Q—Q of FIG. 8A. FIGS. 8A and 8B are views which illustrate the vane-type rotary machine shown in FIGS. 7A and 7B. In this embodiment, the angular ranges of large arcs 40 and small arcs 41 formed in the cam casing 10 are determined by the branch flow passages 23, 33 and the branch flow passages 25, 35.

In the vane-type rotary machine shown in FIGS. 7A and 7B and FIGS. 8A and 8B, the angular ranges of the large arcs 40 and the small arcs 41 are established by adjusting and setting the diameters and angles α, β (see FIG. 8) of flow passages 22*a*, 24*a*, 32*a* and 34*a* of the branch flow passages 23, 25, 33 and 35 (see FIG. 7) which communicate with the branch point 31 of the motor supply opening (pump discharge opening) 30 and the branch point 21 of the motor return opening (pump suction opening) 20. For example, the angles α, β may be made acute for reducing the diameters, and the angles α, β may be made obtuse for increasing the diameters. The angle α is an angle formed between a perpendicular to the flow passages 23*b*, 33*b* of the branch flow passages 23, 33 and the flow passages 22*a*, 32*a*, and the angle β is an angle formed between a perpendicular to the flow passages 24*b*, 34*b* of the branch flow passages 25, 35 and the flow passages 24*a*, 34*a*.

According to the present invention, for downsizing the cam casing, i.e., downsizing the vane-type rotary machine, the angles of the large arcs 40 and the small arcs 41 can univocally be established by the branch flow passages 23, 25, 33 and 35 that are directly machined in the cam casing. Therefore, the large arcs 40 and the small arcs 41 can be machined highly accurately and inexpensively.

As described above, according to the present invention, the following excellent effects can be obtained:

(1) The pressure around the rotor is in equilibrium, and radial loads acting on the rotor shaft are canceled out and the loads on the bearings are reduced. Therefore, wear on the bearings is reduced, resulting in an increase in the mechanical efficiency and the service life of the bearings.

(2) Since the fluid under pressure acting on the vanes is introduced equally into both the vane chambers communicating with the branch flow passages, the efficiency (mechanical efficiency) with respect to the output torque is not reduced.

(3) Since the discharge pressure acts equally in both the vane chambers which communicate respectively with the branch flow passages leading to the pump discharge opening, radial loads acting on the main shaft are canceled out, and the pressure around the rotor is held in equilibrium (is uniformized). Therefore, the loads on the bearings are reduced, leading to an increase in the mechanical efficiency and the service life of the bearings.

(4) Even if the diameters of the branch flow passages are small, the fluid is introduced along the equal distance from the branch point of the pump suction opening into both the vane chambers, thus preventing the pump suction performance from being lowered and the volumetric efficiency from being lowered.

(5) The vane-type rotary machine can be reduced in size easily and reliably.

(6) For downsizing the cam casing, i.e., downsizing the vane-type rotary machine, the angles of the large arcs and the small arcs can univocally be established by the branch flow passages that are directly worked in the cam casing. Therefore, the large arcs and the small arcs can be worked highly accurately and inexpensively.

INDUSTRIAL APPLICABILITY

The present invention can suitably be used for a vane-type rotary machine (a vane pump and a vane motor) which employ a low-viscosity fluid such as water as a working fluid.

The invention claimed is:

1. A vane-type rotary machine having a rotor mounted with vanes and rotatably housed in a cam casing, comprising:

a motor supply opening formed in said cam casing for a working liquid;

a motor return opening formed in said cam casing for the working liquid; and branch flow passages branched from said motor supply opening and said motor return opening and communicating with vane chambers, the distances of said branch flow passages being identical to each other;

wherein the angular ranges of a large arc and a small arc formed in said cam casing are determined by said branch flow passages.

2. A vane-type rotary machine having a rotor mounted with vanes and rotatably housed in a cam casing, comprising:

a motor supply opening formed in said cam casing for a working liquid;

a motor return opening formed in said cam casing for the working liquid; and branch flow passages branched from said motor supply opening and said motor return opening and communicating with vane chambers, the pressure losses in said branch flow passages being identical to each other from ports of said branch flow passages to said vane chambers;

wherein the angular ranges of a large arc and a small arc formed in said cam casing are determined by said branch flow passages.

3. A vane-type rotary machine having a rotor mounted with vanes and rotatably housed in a cam casing, comprising:

a pump discharge opening formed in said cam casing for a working liquid;

a pump suction opening formed in said cam casing for the working liquid; and branch flow passages branched from said pump discharge opening and said pump suction opening and communicating with vane chambers, the distances of said branch flow passages being identical to each other;

wherein the angular ranges of a large arc and a small arc formed in said cam casing are determined by said branch flow passages.

4. A vane-type rotary machine having a rotor mounted with vanes and rotatably housed in a cam casing, comprising:

a pump discharge opening formed in said cam casing for a working liquid;

a pump suction opening formed in said cam casing for the working liquid; and branch flow passages branched from said pump discharge opening and said pump suction opening and communicating with vane chambers, the pressure losses in said branch flow passages being identical to each other from ports of said branch flow passages to said vane chambers;

wherein the angular ranges of a large arc and a small arc formed in said cam casing are determined by said branch flow passages.

* * * * *